US007543558B2

(12) United States Patent
Buck

(10) Patent No.: US 7,543,558 B2
(45) Date of Patent: Jun. 9, 2009

(54) MULTICYLINDER INTERNAL COMBUSTION ENGINE WITH INDIVIDUAL CYLINDER ASSEMBLIES

(75) Inventor: Kenneth M. Buck, Winterville, NC (US)

(73) Assignee: Buck Diesel Engines, Inc., Winterville, NC (US)

( * ) Notice: Subject to any disclaimer, the term of this patent is extended or adjusted under 35 U.S.C. 154(b) by 245 days.

(21) Appl. No.: 11/751,138

(22) Filed: May 21, 2007

(65) Prior Publication Data

US 2007/0209611 A1 Sep. 13, 2007

Related U.S. Application Data

(63) Continuation-in-part of application No. 11/163,947, filed on Nov. 4, 2005, now Pat. No. 7,287,494.

(60) Provisional application No. 60/626,622, filed on Nov. 10, 2004, provisional application No. 60/626,623, filed on Nov. 10, 2004, provisional application No. 60/658,078, filed on Mar. 3, 2005, provisional application No. 60/658,079, filed on Mar. 3, 2005.

(51) Int. Cl.
*F02B 75/22* (2006.01)
*F01L 1/00* (2006.01)

(52) U.S. Cl. ..... 123/195 R; 123/90.1; 29/888.01

(58) Field of Classification Search ..... 123/195 R, 123/90.1, 90.39, 90.48–90.58; 29/888.01, 29/888.03, 888.4, 888.43
See application file for complete search history.

(56) References Cited

U.S. PATENT DOCUMENTS 632,950 A 9/1899 Spence
898,678 A 9/1908 Piggins
900,083 A 10/1908 Clark
904,562 A 11/1908 Rathbun
1,145,995 A 7/1915 Johnson
1,163,671 A 12/1915 Kraus
1,260,847 A 3/1918 Winton
1,408,179 A 2/1922 Du Pont
1,622,965 A 3/1927 Napier et al.
1,624,497 A * 4/1927 McAllister ..... 123/90.55
1,814,676 A 7/1931 Estep (Continued)

OTHER PUBLICATIONS

Lee, Yi-Kuen; Yi, Ui-Cong; Tseng, Fan-Gang; Kim, Chang-Jin "CJ"; Ho, Chih-Ming, "Fuel Injection by a Thermal Microinjector", Mechanical and Aerospace Engineering Department; University of California, Los Angeles, CA; cjkim@seas.ucla.edu.

(Continued)

*Primary Examiner*—Noah Kamen
(74) *Attorney, Agent, or Firm*—Dickinson Wright PLLC

(57) ABSTRACT

An internal combustion engines includes a cylinder carrier with a deck surface, and a crankshaft and a camshaft mounted within the cylinder carrier. A number of valve lifter sleeves are mounted in a depending orientation within bores formed in the deck surface. The lifter sleeves are maintained in contact with the cylinder carrier by cylinder assemblies superimposed upon the sleeves and the cylinder carrier's deck. Valve lifters housed within the lifter sleeves conduct both high-pressure oil running through push rods to an upper portion of the engine cylinder, and low-pressure oil exiting the cylinder. The lifters conduct the low pressure oil to the camshaft's lobes for lubrication purposes.

13 Claims, 16 Drawing Sheets

U.S. PATENT DOCUMENTS 1,850,246 A 3/1932 Simmen
1,906,765 A 5/1933 Purkey
2,423,602 A 7/1947 Magdeburger
2,455,493 A 12/1948 Jacobs
2,491,630 A 12/1949 Voorhies
2,712,483 A 7/1955 Ciaccia
2,858,667 A 11/1958 Reske
3,136,306 A 6/1964 Kamm
3,169,365 A 2/1965 Benjamen
3,398,653 A 8/1968 Foster
3,946,697 A 3/1976 Hackbarth et al.
4,015,908 A 4/1977 Ashley
4,029,071 A 6/1977 Saito et al.
4,033,016 A 7/1977 Mayer
4,041,919 A 8/1977 Bonin
4,068,612 A 1/1978 Meiners
4,133,284 A 1/1979 Holcroft
4,179,884 A 12/1979 Koeslin
4,187,678 A 2/1980 Herenius
4,214,443 A 7/1980 Herenius
4,220,121 A 9/1980 Maggiorana
4,268,042 A 5/1981 Borlan
4,286,931 A 9/1981 Hafele et al.
4,306,614 A 12/1981 Maggiorana
4,308,834 A 1/1982 Eheim
4,348,991 A 9/1982 Stang et al.
4,385,594 A 5/1983 Hauser, Jr.
4,437,444 A 3/1984 Yasuhara
4,449,503 A 5/1984 Luscomb
4,459,945 A 7/1984 Chatfield
4,490,098 A 12/1984 Freudenschuss et al.
4,497,298 A 2/1985 Ament
4,534,241 A 8/1985 Remmerfelt et al.
4,535,592 A 8/1985 Zinsmeyer
4,539,956 A 9/1985 Hengel et al.
4,562,697 A 1/1986 Lawson
4,565,175 A 1/1986 Kaye
4,596,179 A 6/1986 Bando
4,621,594 A 11/1986 Kubis
4,622,864 A 11/1986 Fetouh
4,699,112 A 10/1987 Filippi et al.
4,700,047 A 10/1987 Crossett et al.
4,704,949 A 11/1987 Foster
4,711,088 A 12/1987 Berchem et al.
4,712,985 A 12/1987 Wakasa et al.
4,742,801 A 5/1988 Kelgard
4,759,181 A 7/1988 Biritz
4,763,619 A 8/1988 Eitel
4,790,731 A 12/1988 Freudenschuss
4,807,577 A 2/1989 Koutsoupidis
4,819,606 A 4/1989 Kawano
4,861,243 A 8/1989 Wade
4,873,947 A 10/1989 Ryan, III et al.
4,884,542 A 12/1989 Konrath et al.
4,913,115 A 4/1990 Konrath et al.
4,928,656 A 5/1990 Ausiello
4,961,404 A 10/1990 Itakura et al.
4,968,220 A 11/1990 Filippi et al.
5,004,042 A 4/1991 McMorries, IV et al.
5,014,572 A 5/1991 Swars
5,060,606 A 10/1991 Hubbard
5,072,706 A 12/1991 Eblen et al.
5,095,861 A 3/1992 Dove, Jr.
RE33,870 E 4/1992 Fittro et al.
5,115,771 A 5/1992 Ozawa
5,148,675 A 9/1992 Inman
5,197,188 A 3/1993 Maus et al.
5,209,208 A 5/1993 Siebert et al.
5,303,468 A 4/1994 Cieszkiewicz et al.
5,316,079 A 5/1994 Hedeen
5,327,858 A 7/1994 Hausknecht
5,394,854 A 3/1995 Edmaier et al.
5,415,147 A 5/1995 Nagle et al.
5,433,178 A 7/1995 Urmaza
5,463,867 A 11/1995 Ruetz
5,551,234 A 9/1996 Ochoizki
5,577,470 A 11/1996 Leydorf, Jr. et al.
5,706,675 A 1/1998 Manikowski, Jr.
5,730,093 A 3/1998 Calka et al.
5,732,665 A 3/1998 Morrison
5,732,670 A 3/1998 Mote, Sr.
5,746,270 A 5/1998 Schroeder et al.
5,813,372 A 9/1998 Manthey
5,832,991 A 11/1998 Cesaroni
6,006,730 A 12/1999 Rutke et al.
6,009,850 A 1/2000 DeLuca
6,016,790 A 1/2000 Makino et al.
6,027,312 A 2/2000 Djordjevic
6,073,862 A 6/2000 Touchette et al.
6,098,576 A 8/2000 Nowak, Jr. et al.
6,116,026 A 9/2000 Freese
6,123,144 A 9/2000 Morman et al.
6,178,936 B1 1/2001 Kouchi et al.
6,182,643 B1 2/2001 Canopy
6,196,181 B1 3/2001 Pong
6,227,156 B1 5/2001 Autrey et al.
6,230,676 B1 5/2001 Pryba et al.
6,230,683 B1 5/2001 zur Loye et al.
6,237,554 B1 5/2001 Garrison
6,244,231 B1 6/2001 Kouchi et al.
6,293,335 B1 9/2001 Tawney et al.
6,343,576 B1 2/2002 Ogata et al.
6,347,618 B1 2/2002 Klem
6,357,401 B1 3/2002 Moriyama et al.
6,357,407 B2 3/2002 Brothers
6,360,532 B2 3/2002 Strahle et al.
6,360,728 B1 3/2002 Sturman
6,378,299 B1 4/2002 Schlehuber
6,378,396 B1 4/2002 Reinhardt et al.
6,408,803 B1 6/2002 Atkins
6,415,754 B1 7/2002 Hirano et al.
6,457,442 B1 10/2002 Fuchs et al.
6,484,683 B2 11/2002 Zielke
6,604,515 B2 8/2003 Marsh et al.
6,640,773 B2 11/2003 Ancimer et al.
6,640,775 B2 11/2003 Itoyama et al.
6,651,618 B1 11/2003 Coleman et al.
6,672,989 B2 1/2004 Murata et al.
6,694,945 B2 2/2004 Kawaguchi et al.
6,698,509 B2 3/2004 Rong
6,725,815 B2 4/2004 Cannata
6,729,133 B1 5/2004 Sorter et al.
6,739,293 B2 5/2004 Turner et al.
6,748,906 B1 6/2004 White et al.
6,748,934 B2 6/2004 Natkin et al.
6,755,176 B2 6/2004 Takeuchi et al.
6,758,193 B1 7/2004 Kincaid
6,823,833 B2 11/2004 Ismailov
6,840,209 B2 1/2005 Shimazaki
6,840,211 B2 1/2005 Takahashi
6,840,219 B2 1/2005 Joos et al.
6,840,220 B2 1/2005 Yomogida et al.
6,845,747 B2 1/2005 Rasmussen et al.
6,845,754 B2 1/2005 Pecheny et al.
6,845,757 B2 1/2005 Strahberger et al.
6,941,914 B2 9/2005 Snyder et al.
2006/0005797 A1 1/2006 Schubeck

OTHER PUBLICATIONS

Seatek 600-PLUS 6 Cylinder, Marine Diesel Engine; Feb. 10, 2005; http://boatdiesel.com/Engines/.

* cited by examiner

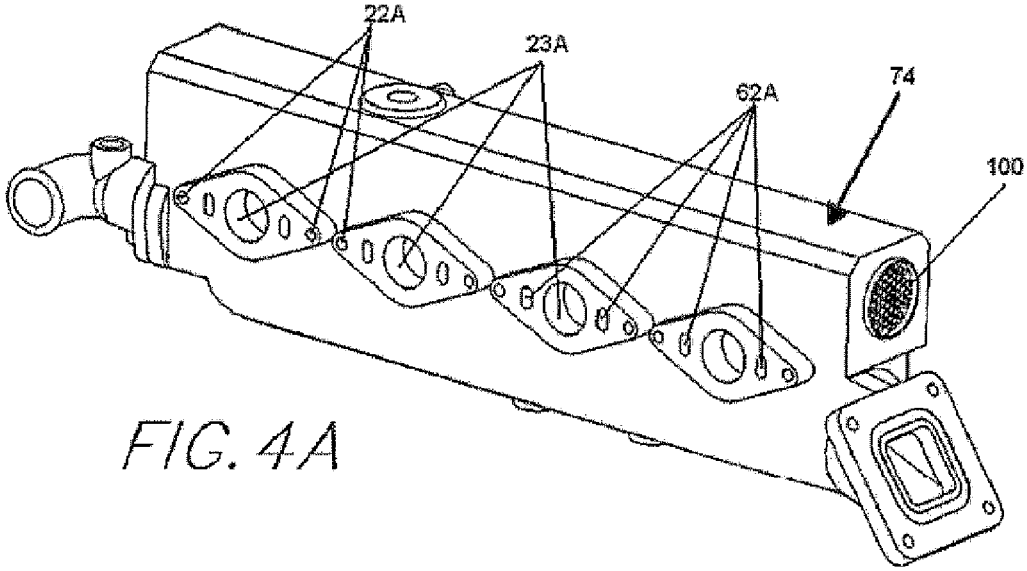
FIG. 4A
FIG. 4B
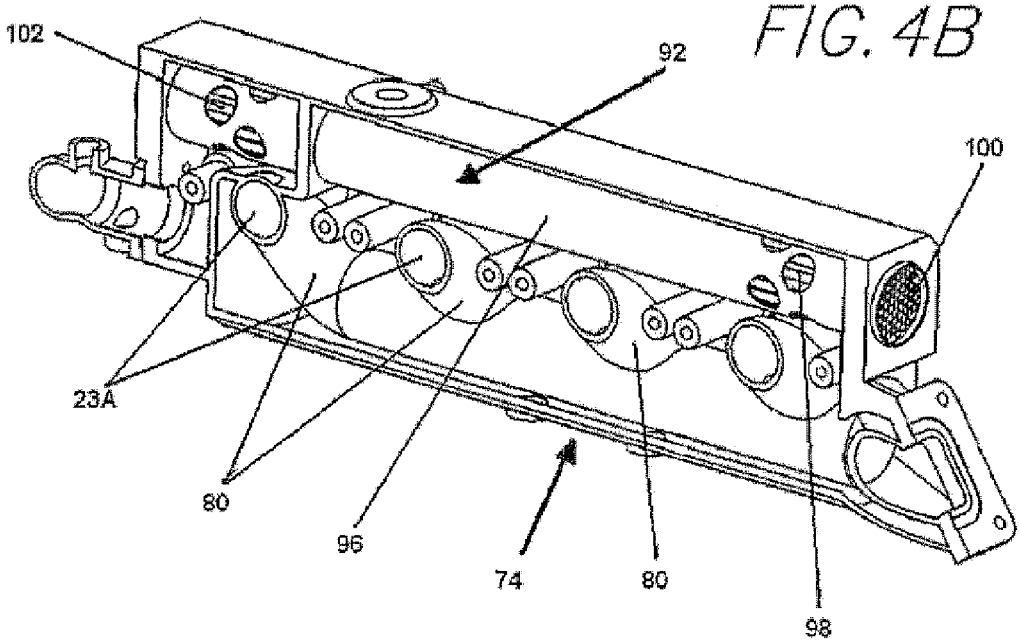

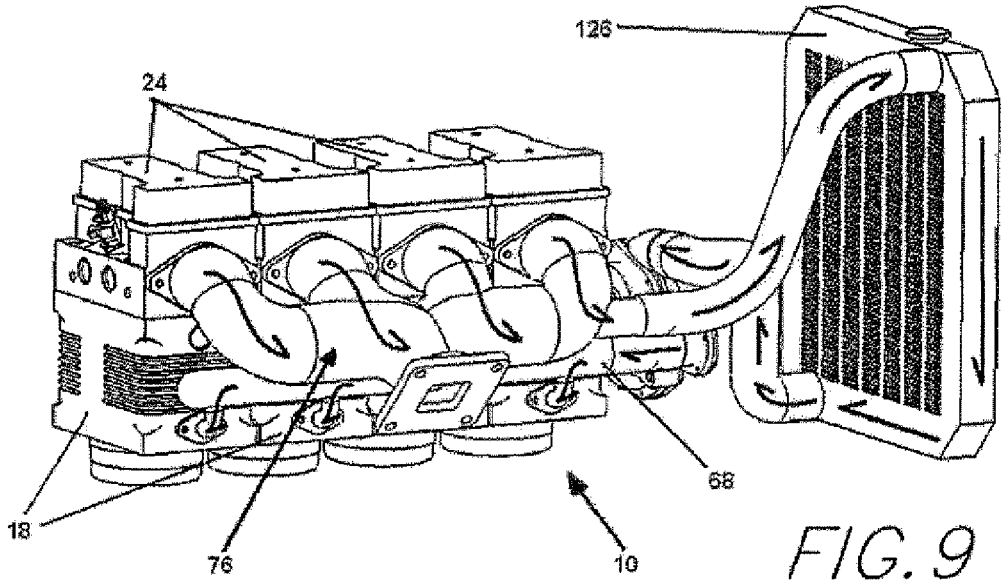
FIG. 9
FIG. 10
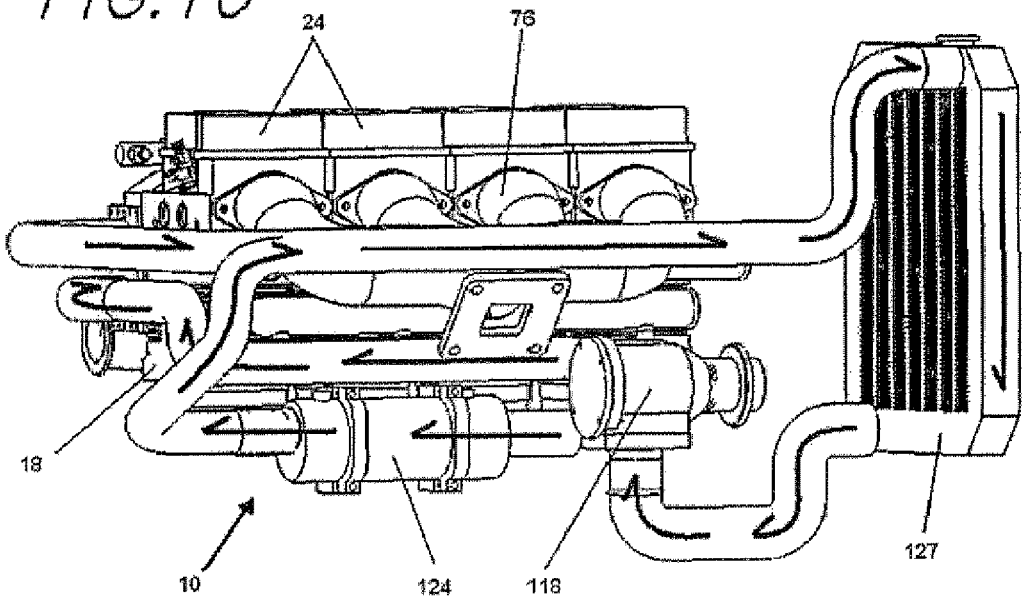

MULTICYLINDER INTERNAL COMBUSTION ENGINE WITH INDIVIDUAL CYLINDER ASSEMBLIES

RELATED APPLICATION(S)

The present application is a continuation-in-part of U.S. application Ser. No. 11/163,947 filed Nov. 4, 2005, now U.S. Pat. No. 7,287,494 which claims priority to U.S. Provisional Patent Applications 60/626,622 and 60/626,623, filed Nov. 10, 2004, and U.S. Provisional Patent Applications 60/658,078 and 60/658,079, filed Mar. 3, 2005.

TECHNICAL FIELD

The present invention relates to an internal combustion engine having individual cylinder assemblies which are mounted upon a cylinder carrier. The cylinder carrier may itself be modularized. The present inventive modular structure is ideally suited to either naturally aspirated engines or engines operated at high specific output, such as turbocharged or supercharged diesel and gasoline engines.

BACKGROUND

The vast majority of multi-cylinder internal combustion engines sold today utilize a single cylinder block containing a plurality of cylinder and valve lifter bores. Unfortunately, if one of the cylinder bores or valve lifter bores becomes damaged to the point where it cannot be repaired by sleeving or by other means commonly used for such repairs, the entire cylinder block must be scrapped. Another drawback characterizing conventional engines resides in the engines' cooling systems. Most engines use a cooling circuit in which water is drawn into a lower portion of the engine, particularly the cylinder block, at only a single location, and then allowed to flow along the length of the cylinder block, while a portion of the water flowing along the length of the cylinder block, and eventually, all of the water, flows upwardly through the cylinder head of the engine. Then, water flows along cooling passages formed within the cylinder head and out of the engine, again at a single location. A drawback of this type of cooling system resides in the fact that the coolant must travel a fairly long path through the engine, and as a result, the coolant becomes quite heated and therefore unable to transfer as much heat as would be the case were the coolant to be introduced at a lower temperature to each cylinder individually, and not forced to flow around the entire engine.

An engine according to the present invention solves the problems described above by providing a true modular construction for the power cylinders. In one embodiment, the cylinder carrier is itself modular. All of the present inventive engines utilize direct fresh water cooling, with individual cooling flows directed to each of the cylinder assemblies. In this manner, the present engine is ideally suited for charge air boosting to fairly high pressures, because the engine offers superior cooling capability as compared with prior art engines.

SUMMARY

A liquid-cooled internal combustion engine includes a plurality of cylinder assemblies mounted individually to a common cylinder carrier. Each cylinder assembly houses a single piston and has a cylinder portion with a cylinder bore, a cylinder head with at least one intake port, and at least one exhaust port, as well as at least one self-contained cooling passage. The present engine also includes a common-rail coolant inlet manifold for introducing an individual coolant flow to each of the self-contained cooling passages within the cylinder assemblies, and an exhaust manifold assembly mounted to each of the cylinder heads, with the exhaust manifold including a plurality of branch passages for receiving exhaust from each of the exhaust ports. The exhaust manifold further includes a number of separate intake coolant passages for conducting coolant flowing from each of the self-contained cooling passages in the cylinder head about an exterior portion of a mating one of each of the exhaust manifold's branch passages.

The self-contained cooling passages in each cylinder assembly extend about the cylinder portion and cylinder head. The coolant is introduced by the coolant inlet manifold into each of the self-contained passages at a location proximate a lower portion of the cylinder portions, so that coolant is first permitted to flow about the cylinder portion, and then about the cylinder head, prior to being discharged into the exhaust manifold at a location proximate the exhaust port corresponding to the particular cylinder in question.

Coolant for the cylinders and cylinder head of the present engine is circulated by means of a primary water pump which circulates either fresh water, or a glycol and water solution, through the cylinder assemblies and then through the cylinder heads into the exhaust manifold. While in the exhaust manifold, a heat exchanger mounted within the manifold transfers heat from coolant flowing from the cylinder assemblies to raw water flowing through a heat exchanger located in the exhaust manifold.

In order to achieve excellent intercooling, a liquid-cooled charge air intercooler is furnished with raw water directly by a raw water pump. Similarly, a liquid-cooled engine oil cooler is furnished with raw water directly by the raw water pump. Raw water is also furnished directly to the previously described heat exchanger situated within the exhaust manifold.

A secondary fluid cooler located downstream from the intercooler transfers heat from a secondary fluid, such as hydraulic fluid, or transmission fluid, or fuel, to raw water flowing from the intercooler.

A turbocharger mounted on an engine according to the present invention preferably includes a cooling jacket for receiving raw water flowing from the oil cooler.

According to another aspect of the present invention, a method for cooling a multi-cylinder internal combustion engine includes the steps of cooling a number of cylinder assemblies by providing an individual flow of fresh water to each of a corresponding number of discrete cooling passages. A separate, discrete cooling passage is routed to and through each of the cylinder assemblies. The present method also includes the step of extracting heat from the fresh water flowing from the cylinder assemblies by means of a direct raw water cooled heat exchanger. The present method also includes the step of extracting heat from a charge air intercooler by providing a direct raw water flow to the intercooler. Finally, the present method may include the step of extracting heat from lubricating oil flowing through the engine by means of a heat exchanger cooled by direct raw water flow.

According to another aspect of the present invention, a cylinder carrier includes a plurality of cylinder mounting modules and a plurality of main bearing bulkheads interposed between and interconnecting adjacent ones of the cylinder mounting modules. A crankshaft is mounted to the main bearing bulkheads. The mechanical strength of the cylinder carrier is enhanced by structural rails, extending longitudinally along the periphery of the cylinder carrier, parallel to the crankshaft's centerline. These structural rails extend vertically and downwardly from a position above the centerline of the crankshaft, to an oil pan.

Each of the cylinder mounting modules preferably comprises a light alloy casting, with each of the main bearing bulkheads preferably comprising a ferrous body. For example, cylinder mounting modules may be formed as aluminum castings, with the main bearing bulkheads being grey or nodular iron, cast steel or other ferrous compositions. As yet another alternative, not only the cylinder mounting modules, but also the main bearing bulkheads may be fabricated from a light alloy.

The present engine further includes a single camshaft extending parallel to the crankshaft centerline. The camshaft operates at least one intake valve and at least one exhaust valve for each of the individual cylinder heads. The camshaft operates the valves by means of at least two rocker shafts extending across an upper portion of each of the cylinder heads in a direction generally perpendicular to the crankshaft centerline.

According to another aspect of the present invention, a method for removing and reinstalling an individual cylinder assembly of an internal combustion engine includes the steps of draining coolant from the engine and removing a plurality of fasteners extending from a cylinder carrier upwardly through a cylinder portion and through a cylinder head. Thereafter, the cylinder head and cylinder portion are lifted from the engine and a wrist pin is shifted left or right within the piston so as to allow the piston to be separated from its connecting rod. Then, a new piston and wrist pin are installed upon the connecting rod and a new cylinder portion is installed upon the piston by sliding a piston ring compression zone of the cylinder portion over a plurality of piston rings carried upon the piston. Thereafter, the new cylinder portion is seated upon a pilot diameter formed in the cylinder carrier and the cylinder head is mounted upon the engine. Preferably, each of the cylinder portions has a ferrous cylinder sleeve pressed in place in the cylinder portion.

According to another aspect of the present invention, a method for replacing crankshaft main bearing inserts in a reciprocating internal combustion engine includes the steps of removing an oil pan mounted to structural rails of the bottom of the engine's crankcase, and then removing at least one of the structural rails extending longitudinally along a portion of a cylinder carrier parallel to the crankshaft's centerline. The structural rail also extends vertically from a position above the centerline of the crankshaft to the oil pan. After the structural rail is removed, a number of main bearing caps will be removed serially from the cylinder carrier while replacing the main bearing inserts associated with each of the bearing caps. Thereafter, the engine is completed by reinstalling the previously removed structural rail and the oil pan.

According to another aspect of the present invention, at least two valve lifters are provided for each cylinder. The lifters are slidingly housed within valve lifter sleeves mounted within bores formed in a deck surface of the engine's cylinder carrier. Each of the lifter sleeves includes a generally circular, hollow cylinder having a flange at one end, which engages a counterbore formed in the deck surface.

According to another aspect of the present invention, each valve lifter has a center bore for feeding lubrication to a pushrod riding upon the lifter. A radially directed passage conducts lubricant to the center bore from an annular lubrication collection passage circumscribing a portion of the outer periphery of the valve lifter. Oil, which moves upwardly through the pushrods, is allowed to flow through drainback passages formed in the lifters, so that the camshaft's lobes are lubricated.

According to yet another aspect of the present invention, a method for installing a cylinder poppet valve operating system in an internal combustion engine includes installing a camshaft in a cylinder carrier having a deck surface; installing a valve lifter sleeve in a bore formed through the deck surface; installing a valve lifter in the lifter sleeve; and installing a cylinder assembly upon the deck surface, such that the cylinder assembly contacts a portion of the valve lifter sleeve, whereby the valve lifter sleeve will be retained within the lifter bore. Then, a pushrod is installed through a passage within the cylinder assembly, such that the pushrod is in contact with an upper surface of the valve lifter. Finally, a rocker arm assembly may be installed upon a cylinder head mounted at an upper portion of the cylinder assembly.

It is an advantage of an engine according to the present invention that a valve lifter and lifter sleeve arrangement allows the upper portion of the engine's cylinder assemblies to be lubricated without the need for the extensive machining which accompanies the provision of multiple oil passages in conventional engines.

It is another advantage of an engine system according to the present invention that the engine's valve components may be replaced without resort to the expensive and time consuming machining services normally associated with the overhaul of valve lifter bores. This advantage results from the ability to remove and replace the lifter sleeves without the need of any machining devices.

Other advantages, as well as features of the present invention, will become apparent to the reader of this specification.

BRIEF DESCRIPTION OF THE DRAWINGS

FIGS. 4A and 4B show an exhaust manifold according to the present invention.

FIG. 9 illustrates a primary or fresh water cooling system path of a non-marine engine according to the present invention and having a radiator.

FIG. 10 is similar to FIG. 9 but shows the secondary cooling system path of a non-marine engine according to the present invention and having a radiator.

DETAILED DESCRIPTION OF THE PREFERRED EMBODIMENTS

Figure 1:
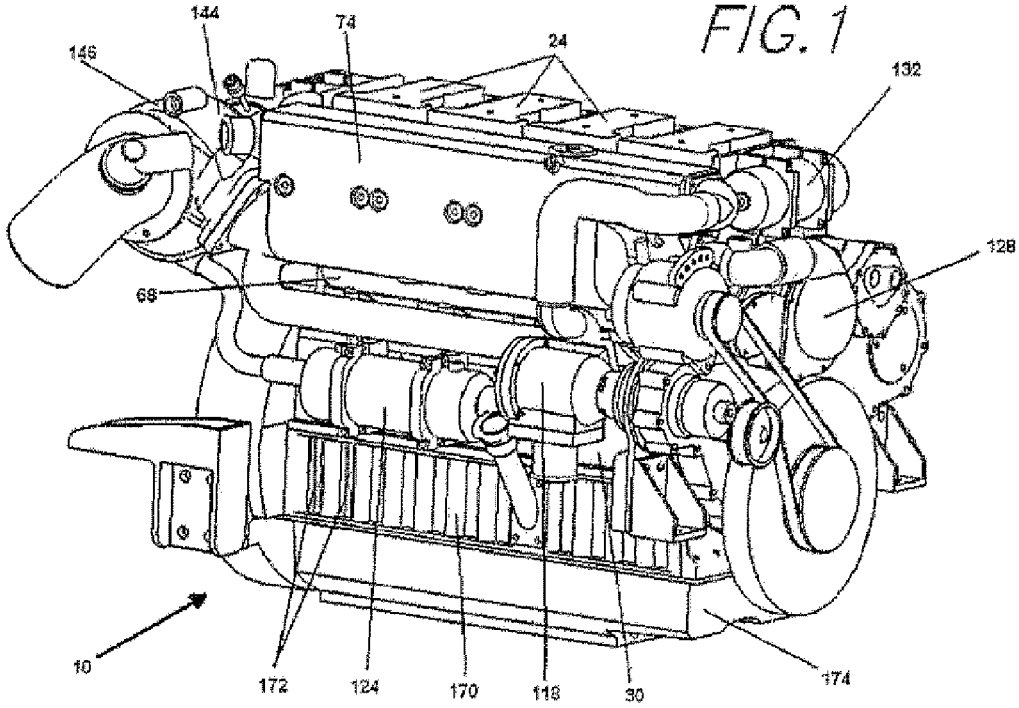
FIG. 1 is a perspective view of an engine according to the present invention.
Figure 6:
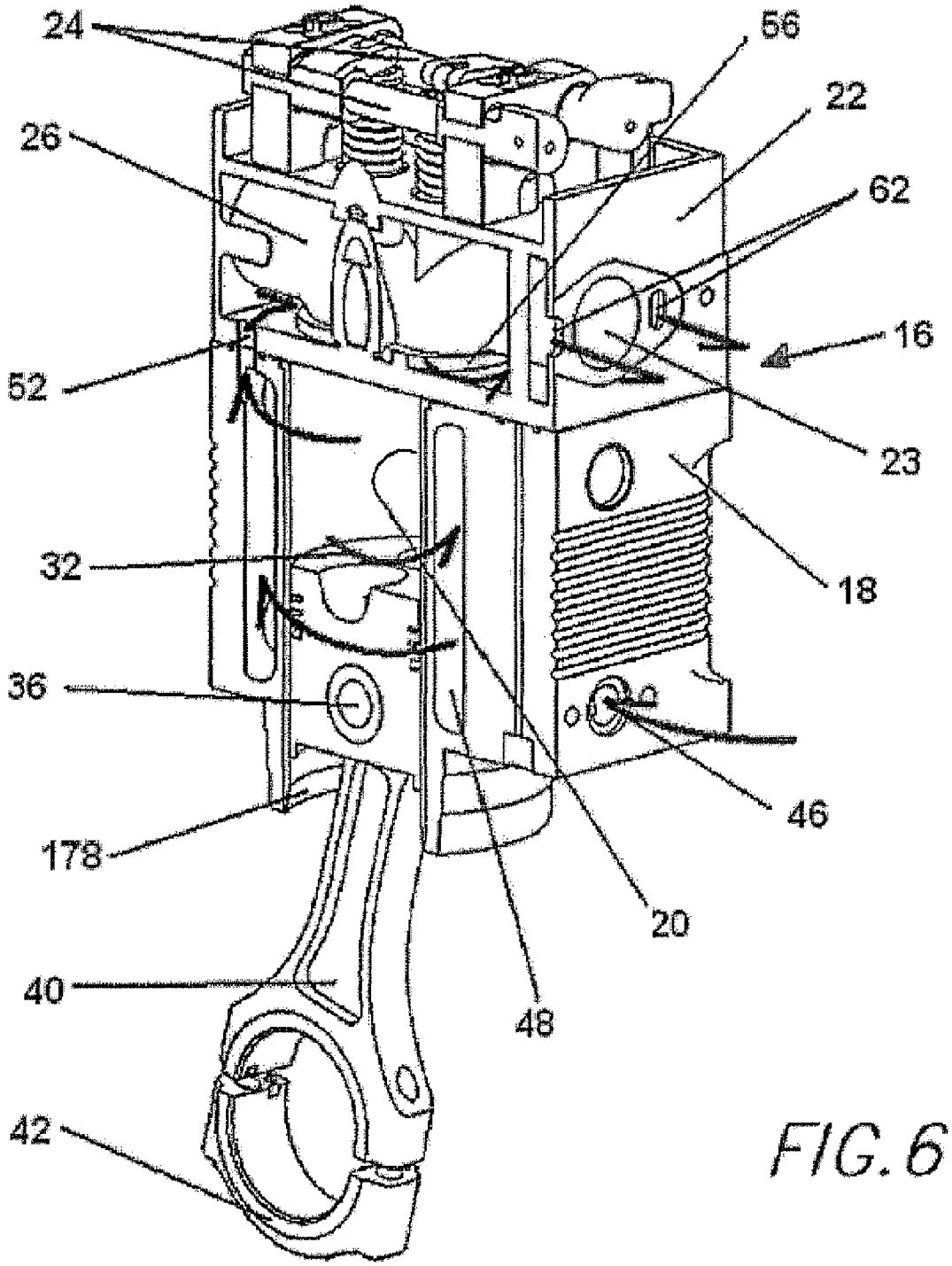
FIG. 6 is a cutaway perspective view of a cylinder assembly according to the present invention.

As shown in FIG. 1, engine 10 is an inline engine which is turbocharged and which has a liquid-cooled exhaust manifold for marine use. A primary water pump, 128, circulates fresh water through exhaust manifold assembly 74, as well as through the cylinder assemblies 16, which are shown more clearly in FIGS. 2, 6, and 13. As used herein, the term "fresh water" has the conventional meaning: i.e., coolant which is not extracted from a body of water upon which a vessel is being operated, but rather is cooled by a heat exchanger. Each cylinder assembly 16, which is shown freestanding in FIG. 6, includes cylinder portion 18, having a cylinder bore 20, which is normally fitted with a honed iron sleeve. Cylinder portion 18 is preferably cast from a light alloy such as an aluminum or magnesium alloy. Alternatively, other metals such as iron could be employed for forming cylinder portion 18. Cylinder head 22 is mounted to an upper portion of cylinder portion 18. Cylinder head 22, as shown in FIG. 6, also includes intake port 26 and exhaust port 23.

Figure 13:
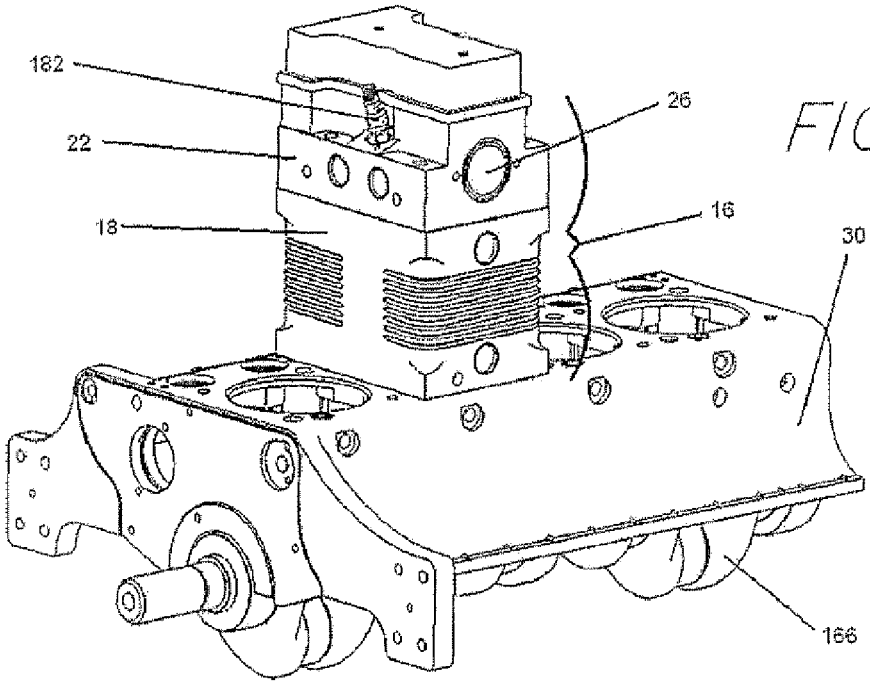
FIG. 13 illustrates a unitary cylinder carrier according to one aspect of the present invention having a cylinder assembly 16 mounted thereto.

FIG. 13 depicts a fuel injector, 182, which may comprise either a diesel injector, a gasoline injector, a natural gas injector, a nitrous oxide injector, or yet other types of fuel injectors known to those skilled in the art and suggested by this disclosure. At least one injector 182 is mounted to each of cylinder assemblies 16.

FIGS. 1, 2, 3, and 9 illustrate coolant supply manifold 68, which functions as a common rail to provide an individual coolant flow to self-contained cooling passages located within cylinder assembly 16 (FIG. 13). In essence, each of cylinder assemblies 16 is provided with coolant, which has not flowed through other cylinder assemblies. As shown in FIG. 6, coolant enters cylinder assembly 16 through coolant inlet port 46 and then travels through water jacket 48 located about cylinder bore 20. After circulating about water jacket 48, coolant flows through transfer ports 52 and up into transverse cooling passage 56 formed within cylinder head 22. After having flowed through transverse cooling passage 56, coolant exits cylinder head 22 by means of coolant outlet ports 62. These coolant outlet ports are shown in FIG. 6, as well as in FIG. 2.

Fresh water coolant flowing from outlet ports 62 of each of cylinder heads 22 flows through ports 62A formed in exhaust manifold 74 (FIG. 4A). Then, coolant flows around exhaust branch passages 80 and then through inlet ports 98 and inside shell 96 of coolant heat exchanger 92 (FIG. 4B). After entering shell 96, coolant flows around the tubes of tube bundle 100 contained within coolant heat exchanger 92. Then, coolant exits heat exchanger 92 by flowing through outlet ports 102 formed in shell 96. Leaving heat exchanger 92, the fresh water coolant recirculates through primary water pump 128 and back through coolant inlet manifold 68 and into cylinder assemblies 16.

Figure 7:
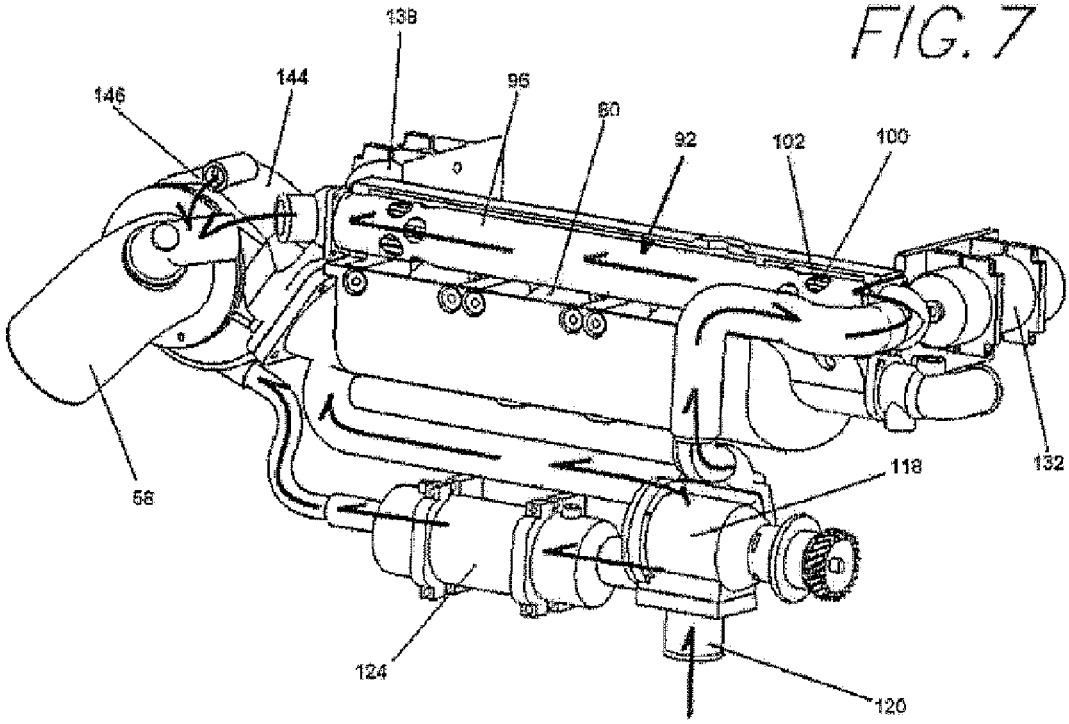
FIG. 7 is similar to FIG. 3 but shows additional aspects of a raw water cooling system and flows according to the present invention.

Tube bundle 100 is cooled by means of a direct raw water flow provided by raw water pump 118 which is shown in FIGS. 1, 2, 7, and 10. Raw water is furnished to one end of tube bundle 100 located at the front of the engine, as shown in FIG. 7, and having traversed the length of tube bundle 100 and with the raw water traveling inside the numerous small tubes of the tube bundle, the raw water exits and flows into exhaust elbow 58. Because raw water is provided directly to coolant heat exchanger 92, high efficiency cooling is achieved, so as to allow high boosting rates with the present engine.

Turning now to FIG. 7, raw water pump 118 has inlet 120 which picks up raw water at ambient temperature from a lake, river, or ocean. The flow is immediately split into three separate flows. A first single flow passes through engine oil cooler 124 and then to turbocharger cooling jacket 146, which surrounds a portion of turbocharger 144. After flowing through turbocharger cooling jacket 146, the water flows into exhaust elbow 58. The second single flow of the raw water flow split from raw water pump 118 flows, as previously described, through the engine's fresh water cooling system heat exchanger.

Figure 8:
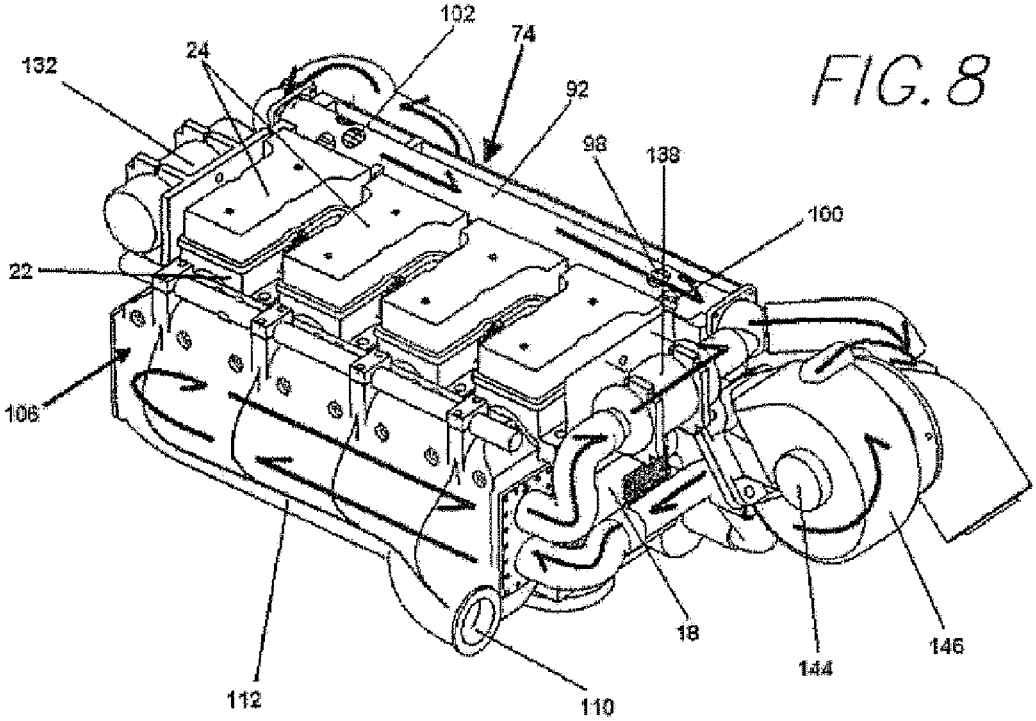
FIG. 8 illustrates the flow path through an intercooler of an engine according to the present invention.

The third separate flow of the raw water split from the flow through raw water pump 118 flows through intercooler coil 112 (not visible), located inside intake manifold 106 which is shown in FIG. 8 and receives direct raw water flow from pump 118. Air arriving at intake manifold 106 passes from turbocharger 144 into air inlet 110 and then flows upwardly through intercooler heat exchanger 112 and into intake ports 26 of cylinder assemblies 16 visible on FIG. 13. Because raw water is provided directly to intercooler heat exchanger coil 112, the raw water is at a much colder temperature than would otherwise be the case were the water to be used to cool some other part of the engine, such as the engine oil cooler, before entering intercooler 112. This is not the case with known engines.

Raw water leaving intercooler 112 passes through secondary fluid cooler 138, which is shown in FIG. 8. Cooler 138 may be used for the purpose of extracting heat from transmission fluid, or other types of fluids used in a vehicle or boat having the present engine. Coolant expansion tank 132 is mounted at the opposite end of the engine from secondary fluid cooler 138. Expansion tank 132 accounts for the fact that known engine coolants generally have a positive coefficient of thermal expansion. Expansion tank 132 allows for this expansion without the necessity of admitting air into the cooling system.

Figure 5A:
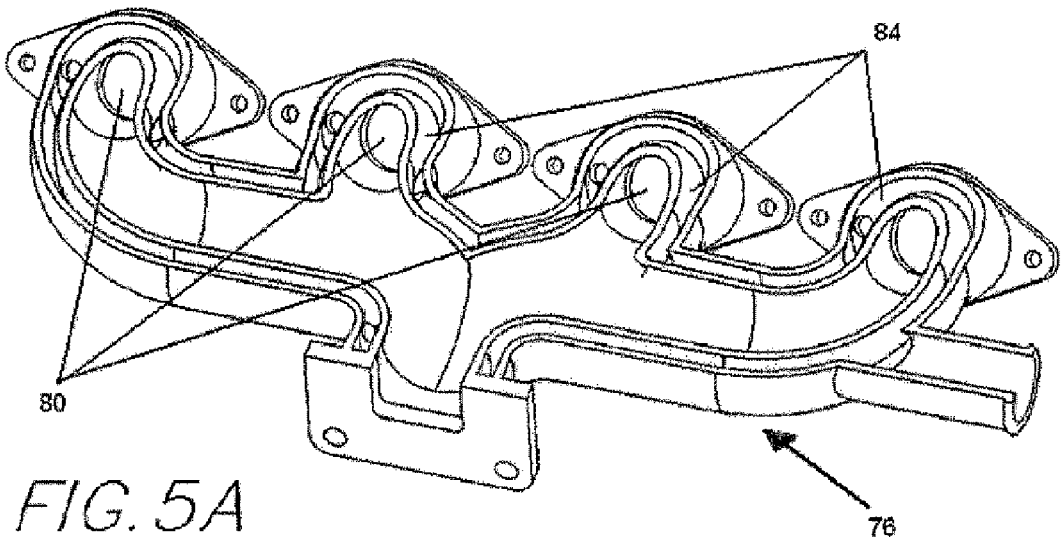
FIGS. 5A and 5B illustrates a liquid-cooled exhaust manifold suitable for use with a non-marine engine according to the present invention.
Figure 5B:
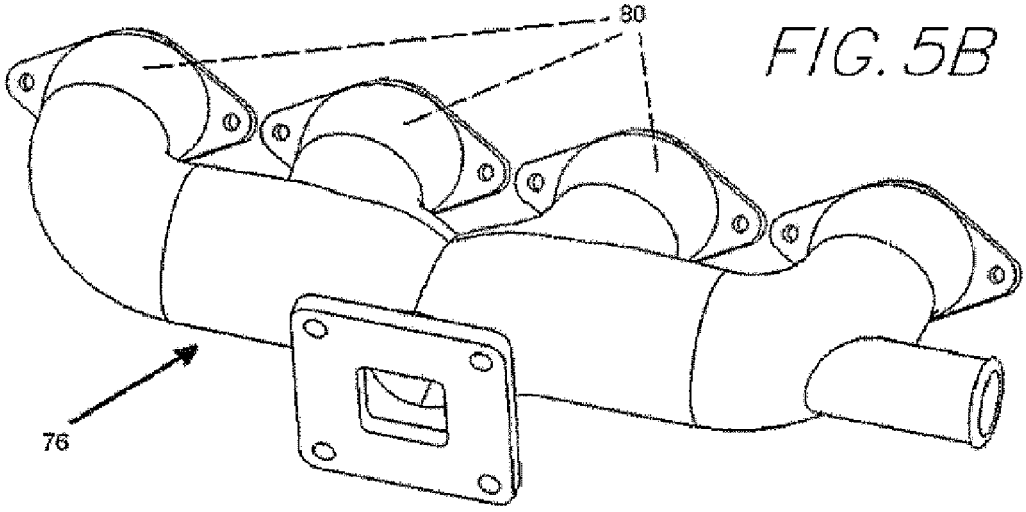

FIGS. 5A and 5B illustrate an exhaust manifold, 76, suitable for use with a non-marine variant of the present engine. The manifold 76 of FIGS. 5A and 5B is, however, liquid-cooled and the annular discharge coolant passages 84 are readily ascertainable in FIG. 5A.

The manifold of FIGS. 5A and 5B may be combined with the radiator, 126, illustrated in FIG. 9. For the sake of clarity, the primary fresh water cooling system shown in FIG. 9 is separated from the secondary cooling system shown in FIG. 10. In reality, both systems rely on the rejection of heat to the ambient air, which radiators 126 and 127 provide. Note in FIG. 10, however, that a salient feature of the present invention resides in the fact that cooled water from radiator 127, is used for the purpose of providing water to the cooling circuits furnished with raw water in the marine embodiments described earlier. Also in a vehicular system, the two cooling circuits would likely be combined into one, with the use of a single sufficiently large radiator and a single sufficiently large pump with a split pump discharge providing the coldest possible coolant flow to the engine coolant supply manifold, oil cooler, and intercooler. Cooling of the turbocharger is not normally required in a vehicular application.

Figure 14:
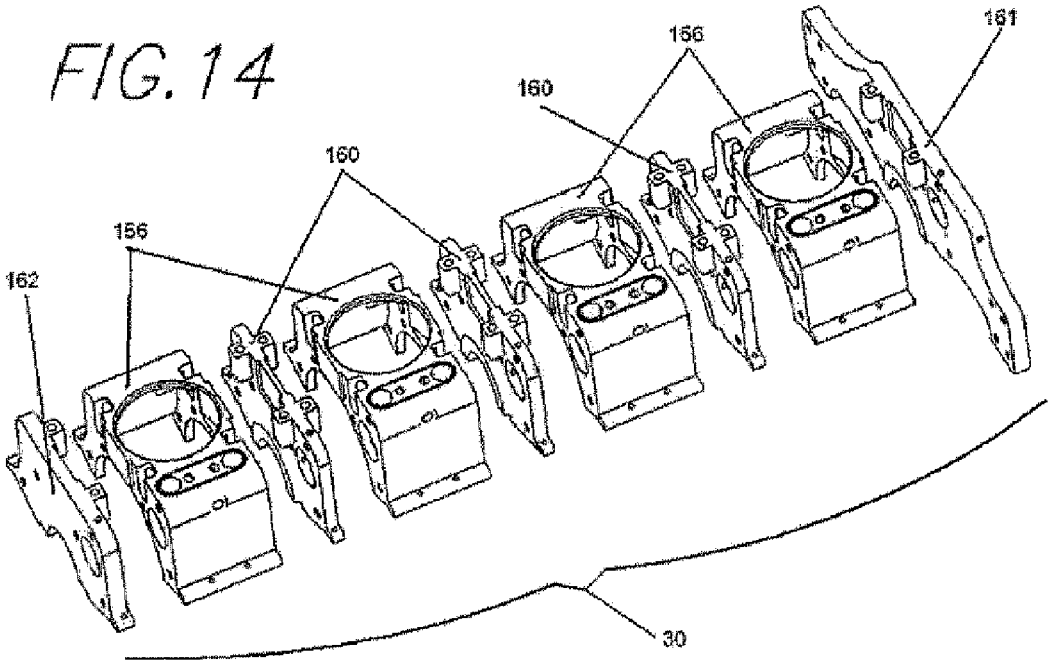
FIG. 14 is an exploded view of a modular cylinder carrier according to one aspect of the present invention.
Figure 15:
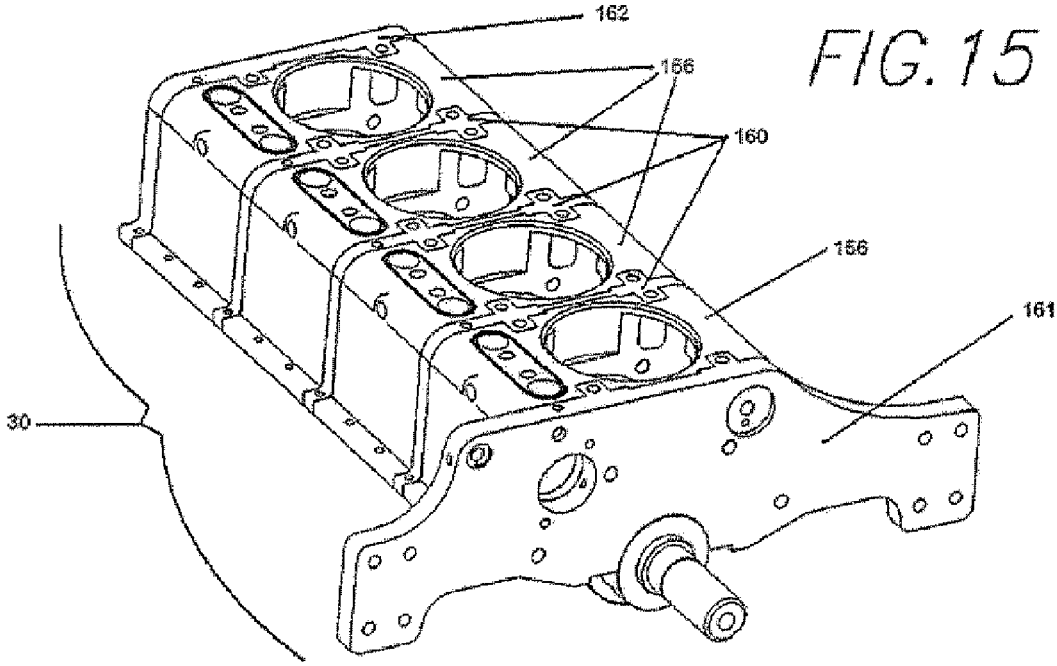
FIG. 15 illustrates the components of FIG. 14 after assembly into an engine carrier.

Details of the bottom end of the present engine are shown in FIGS. 11-15. The engines shown in FIGS. 11, 12 and 13 include a unitary cylinder carrier, 30, providing a base for a plurality of cylinder assemblies 16 (FIG. 13). FIGS. 14 and 15, on the other hand, show a modular cylinder carrier for a four-cylinder engine in which four separate mounting modules 156 are joined together by means of three main bearing bulkheads 160. Cylinder mounting modules 156 and bulkheads 160 are maintained in an assembly by means of threaded fasteners (not shown). FIG. 15 shows a completed cylinder carrier 30 which also includes an end bulkhead, 161, at the front of the engine. Bulkhead 161 has provisions for the front engine mounts. A rear bulkhead, 162, is provided for terminating the rear end of the modular cylinder carrier 30 shown in FIGS. 14 and 15. It is easily seen from FIGS. 14 and 15 that an engine according to the present invention may be assembled with varying numbers of cylinders merely by adding more or fewer cylinder mounting modules 156 and bulkheads 160.

Figure 11:
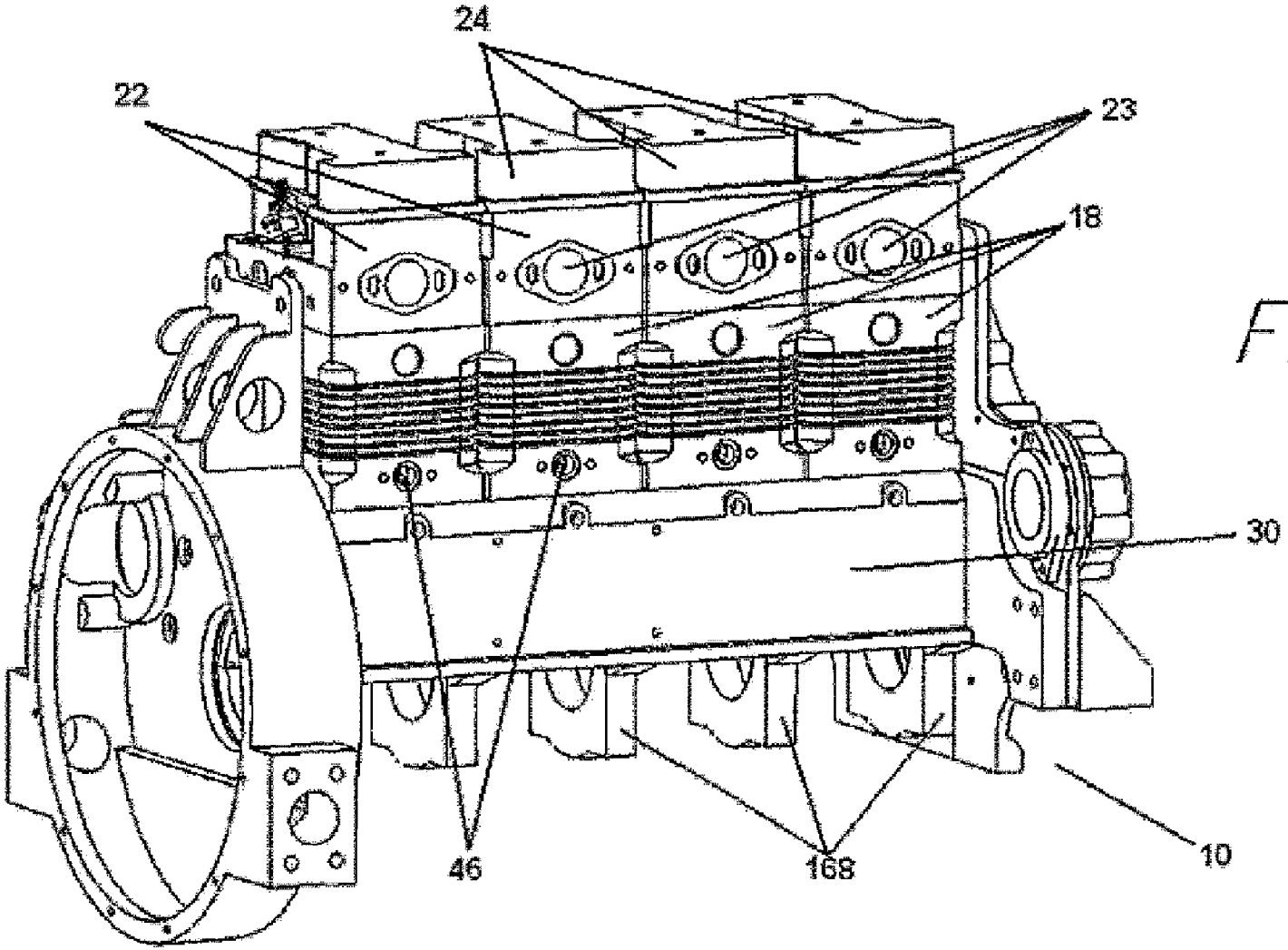
FIG. 11 illustrates placement of the main bearing caps in an engine according to the present invention.
Figure 12:
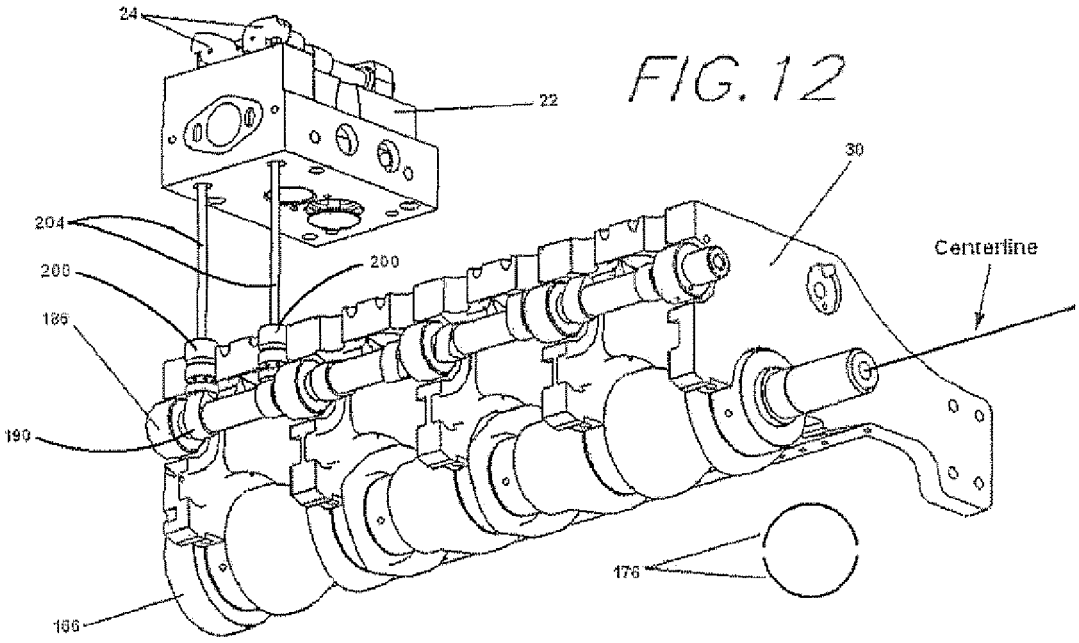
FIG. 12 illustrates placement of a crankshaft within an engine according to the present invention.

Regardless of the number of cylinders of engine 10, FIGS. 11 and 12 illustrate a feature providing for ready disassembly and repair of the present engine even when the engine is mounted within a watercraft, a motor vehicle, or another piece of machinery. Cylinder carrier 30, whether of a one-piece configuration as shown in FIGS. 11, 12 and 13, or in a modular configuration as shown in FIGS. 14 and 15, extends downwardly only to a position above the centerline of the crankshaft and main bearing bores. Thus, as shown in FIG. 12, inserts 176 for each of the main bearings of crankshaft 166 may readily be removed from engine 10 once the appropriate main bearing cap 168 (FIG. 11) has been removed.

Figure 2:
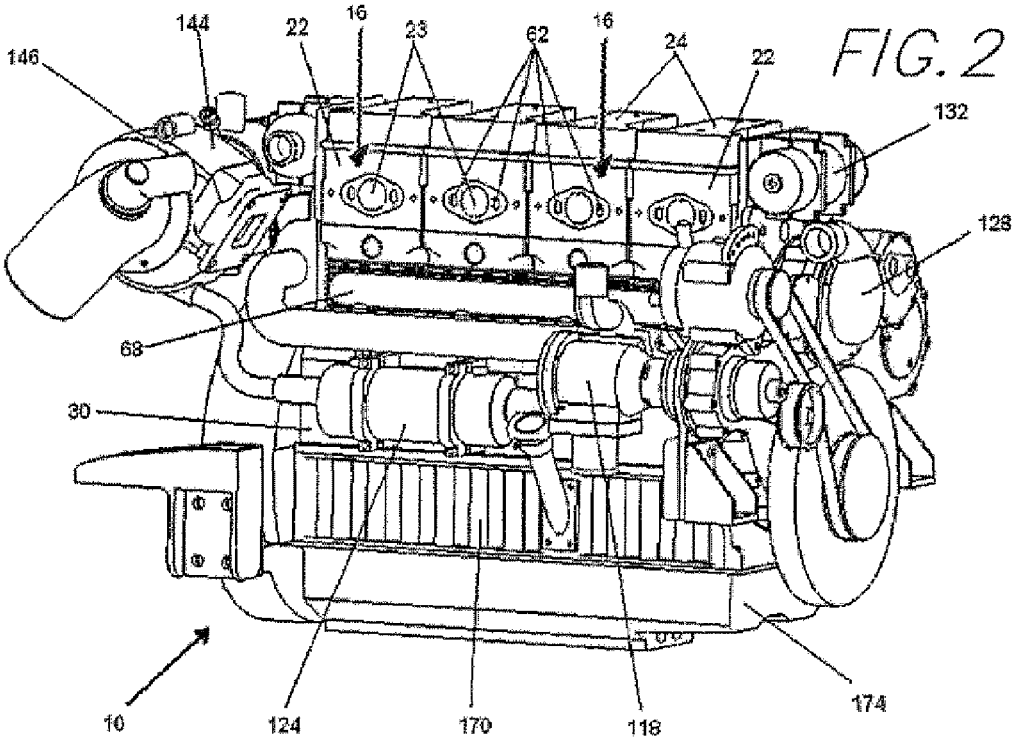
FIG. 2 is similar to FIG. 1, but shows the engine of FIG. 1 with the exhaust manifold assembly removed.
Figure 3:
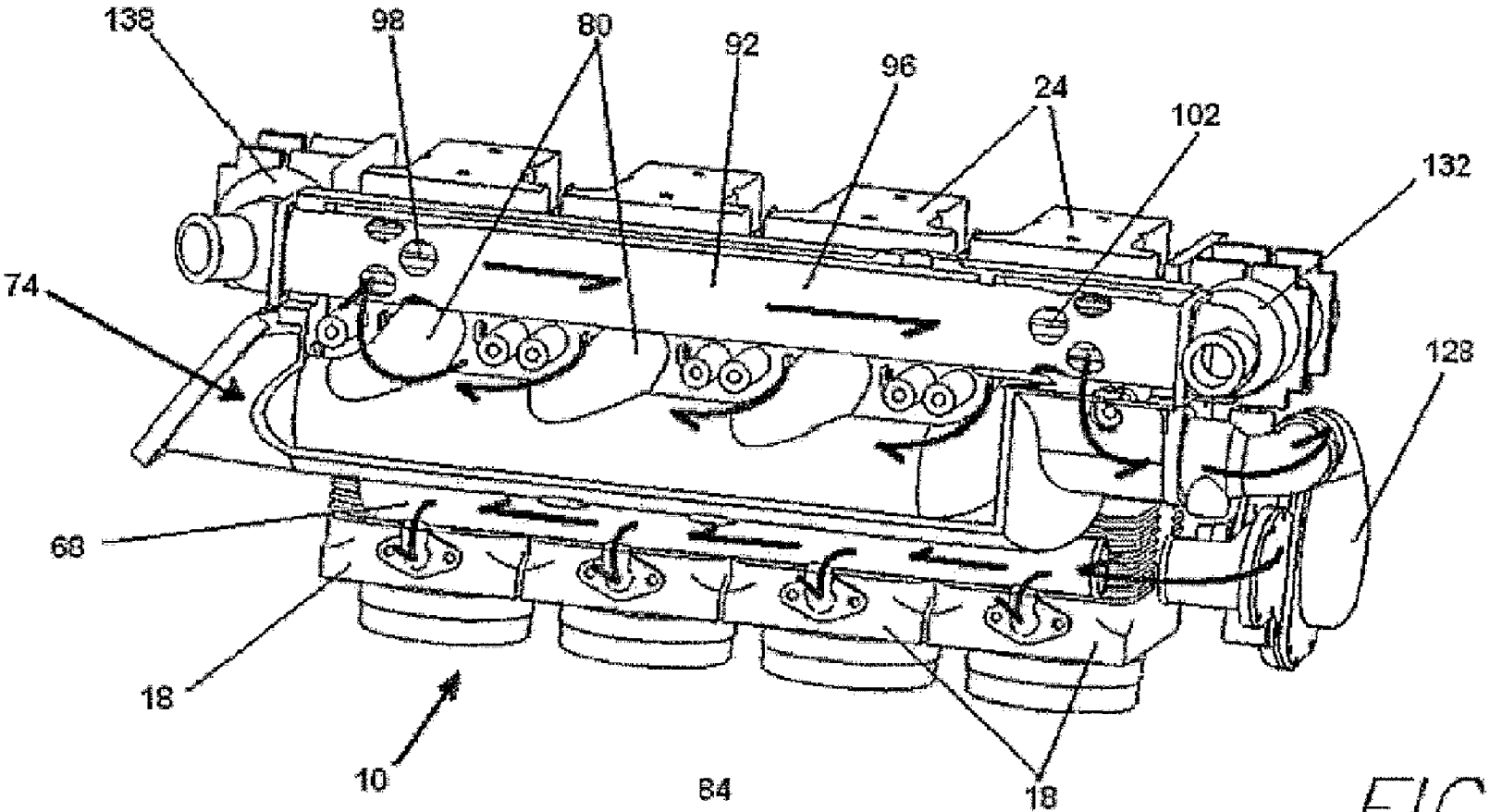
FIG. 3 illustrates various flow paths for the primary, or fresh water, cooling system of an engine according to the present invention.

Removal of main bearing inserts 176 is aided by the removability of structural rails 170 (FIGS. 1 & 2). Structural rails 170 are used on both sides of engine 10. In addition to providing rigidity equal to or better than would be available with a deep skirt cylinder block, rails 170 allow ready access to fasteners for main bearing caps 168 (FIG. 11). After rails 170 have been removed from engine 10, as explained below, by removing the fasteners from oil pan 174, crankshaft bearings 176 are exposed, as may be visualized from FIGS. 11 and 12.

According to another aspect of the present invention, a method for replacing crankshaft main bearing inserts in a reciprocating internal combustion engine includes the steps of removing oil pan 174 and then removing structural rail 170 from at least one side of engine 10. Structural rail 170, oil pan 174, and cylinder carrier 30 are attached to another by means of through bolts 172 (FIG. 1) which extend through oil pan 174, and then through passages formed in structural rails 170, and into suitably tapped holes within carrier 30. Once structural rail 170 has been removed from the engine, main bearing caps 168 may be removed serially and the bearing inserts renewed using conventional techniques.

The present engine, whether having either a modular, or a non-modular cylinder carrier 30, permits ready removal and reinstallation of an individual cylinder assembly. Experience shows that frequently, only one cylinder of an engine may be worn excessively. All too often with mono-block engines, it becomes necessary to scrap the entire block because it is not possible to rebore the cylinder. Even if reboring is an option, in an engine application such as a pleasure boat, it is not possible to machine anything on the cylinder block without removing the engine from the boat. Such removal is extremely costly, and particularly so, in the case of boats having multiple decks above the engine room.

In contrast with prior art engines, with the present inventive engine it is possible to replace a cylinder assembly, including the piston, and, if necessary, the connecting rod, without removing the engine from a boat or other vehicle. Should removal of a marine variant of the present engine become necessary, however, the engine may be removed without the necessity of cutting an access hole in either the decks or hull of a boat, because once cylinder heads 22 and cylinder portions 18, as well as pistons 32, and connecting rods 40 (FIG. 6) have been removed from the engine, along with structural rails 170, oil pan 174 (FIGS. 1 & 2), crankshaft 166 (FIGS. 12 & 13), and other small components, carrier 30 may be removed without the need for lifting equipment, which is generally unavailable below decks in most boats.

If it becomes necessary to remove and reinstall an individual cylinder assembly 16 of engine 10 according to the present invention, the steps for such removal and reinstallation include draining coolant from engine 10, removing a plurality of fasteners 172 extending from cylinder carrier 30 upwardly through cylinder portion 18 and cylinder heads 22, and lifting cylinder head 22 and cylinder portion 18 from carrier 30. Then, wrist pin 36 may be removed and a new piston, 32, installed upon connecting rod 40. Thereafter, cylinder portion 18 may be slidably installed upon piston 32 by sliding piston ring compression zone 178 (FIG. 6) over piston 20 and its piston rings. In essence, piston ring compression zone 178 makes it possible to reinsert pistons 32 into the bottom of cylinder bores 20 without the need of any additional ring compressor or other device. Also, it should be noted that with the exception of crankshaft 166, no machining is required to rebuild an engine according to the present invention.

Figure 16:
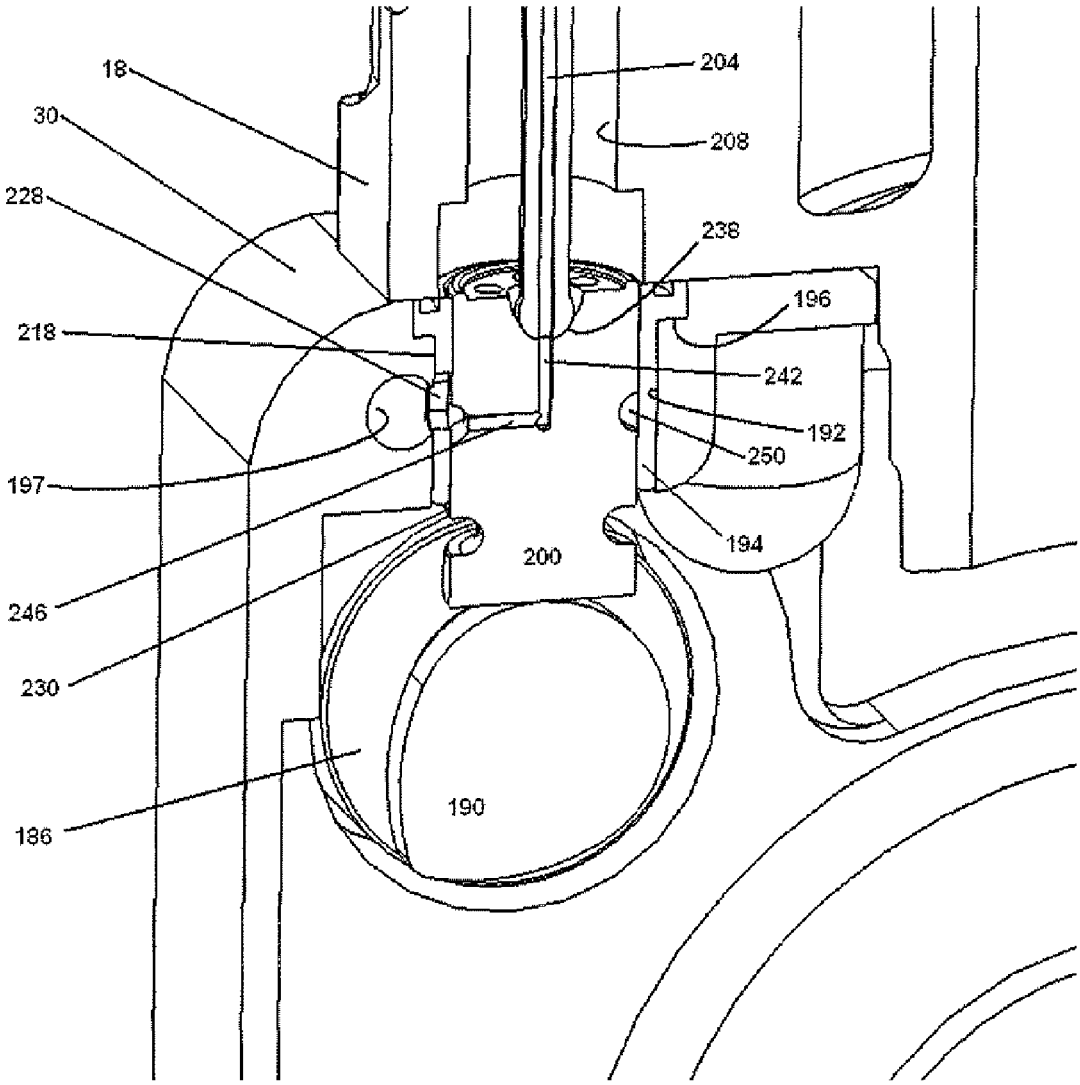
FIG. 16 is a view, partially in section, and partially an elevation, showing a valve lifter sleeve, a valve lifter, and associated hardware according to the present invention.

FIGS. 12 and 16 illustrate aspects of the valve actuation portion of the present engine system. Carrier 30 has crankshaft 166 and camshaft 186 installed therein, with camshaft 186 having a plurality of lobes, 190, which actuate the valve train as follows. Valve lifters 200 are situated within valve lifter sleeves 194, which in turn are sited within valve lifter bores 192 formed within cylinder carrier 30. Note that bore 192 has a counter bore, 196, which, as noted below, engages a flange formed at an end portion of valve lifter sleeve 194. Continuing now with FIG. 16, valve lifter 200 is mounted within valve lifter sleeve 194 and contacts a lower end of a push rod, 204. When cam lobe 190 raises lifter 200, push rod 204 will correspondingly be raised. Push rod 204 passes through the cylinder portion 18 of cylinder assembly 16 through a passageway, 208, to an upper portion of cylinder assembly 16.

Figure 17:
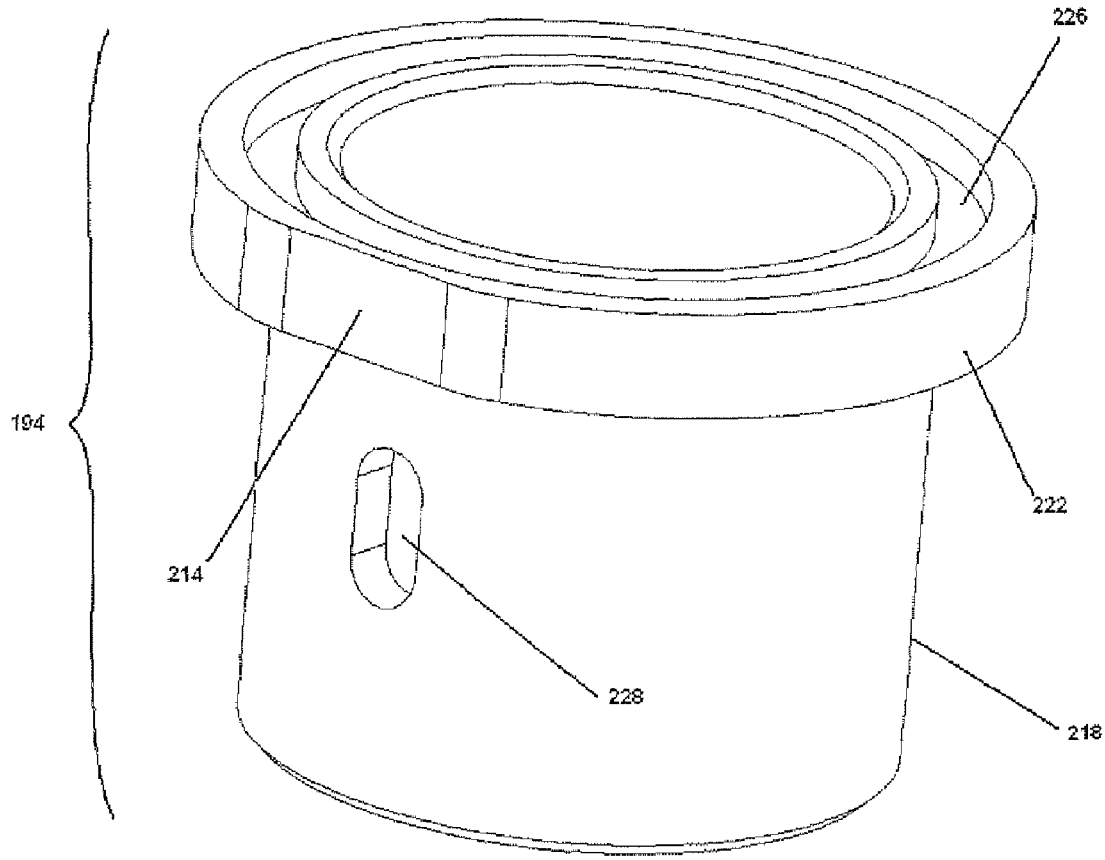
FIG. 17 is a perspective view of a valve lifter sleeve according to one aspect of the present invention.

FIG. 17 shows various details of valve lifter sleeve 194. Sleeve 194 is configured as a generally circular hollow cylinder having a cylindrical outer surface 218 and an upper flange 222, which engages counter bore 196 formed in deck 200 of carrier 30. Flange 222 prevents lifter sleeve 194 from moving downwardly within valve lifter bore 192 past the design location for lifter sleeve 194. In essence, lifter sleeve 194 is mounted in a depending orientation within lifter bore 192.

As shown in FIG. 17, valve lifter sleeve 194 has an annular groove, 226, in the upper surface of upper flange 222, which provides a mounting location for a sealing O-ring (not shown) which is engaged by cylinder portion 18 of cylinder assembly 16 when cylinder portion 18 is bolted to carrier 30. Accordingly, cylinder assembly 16 prevents lifter sleeve 194 from becoming disengaged with carrier 30.

Lifter sleeve 194 has an indexing surface or flatted area, 214, aligned with an elongated, radially directed oil passage, 228. Passage 228 receives oil from a pressurized oil galley, 197 (FIG. 16), within carrier 30 and allows oil to pass through to lifter 200, as described below. Indexing feature 214 prevents lifter sleeve 194 from rotating to a position at which oil passage 228 is not properly indexed with oil passage 197.

Figure 18:
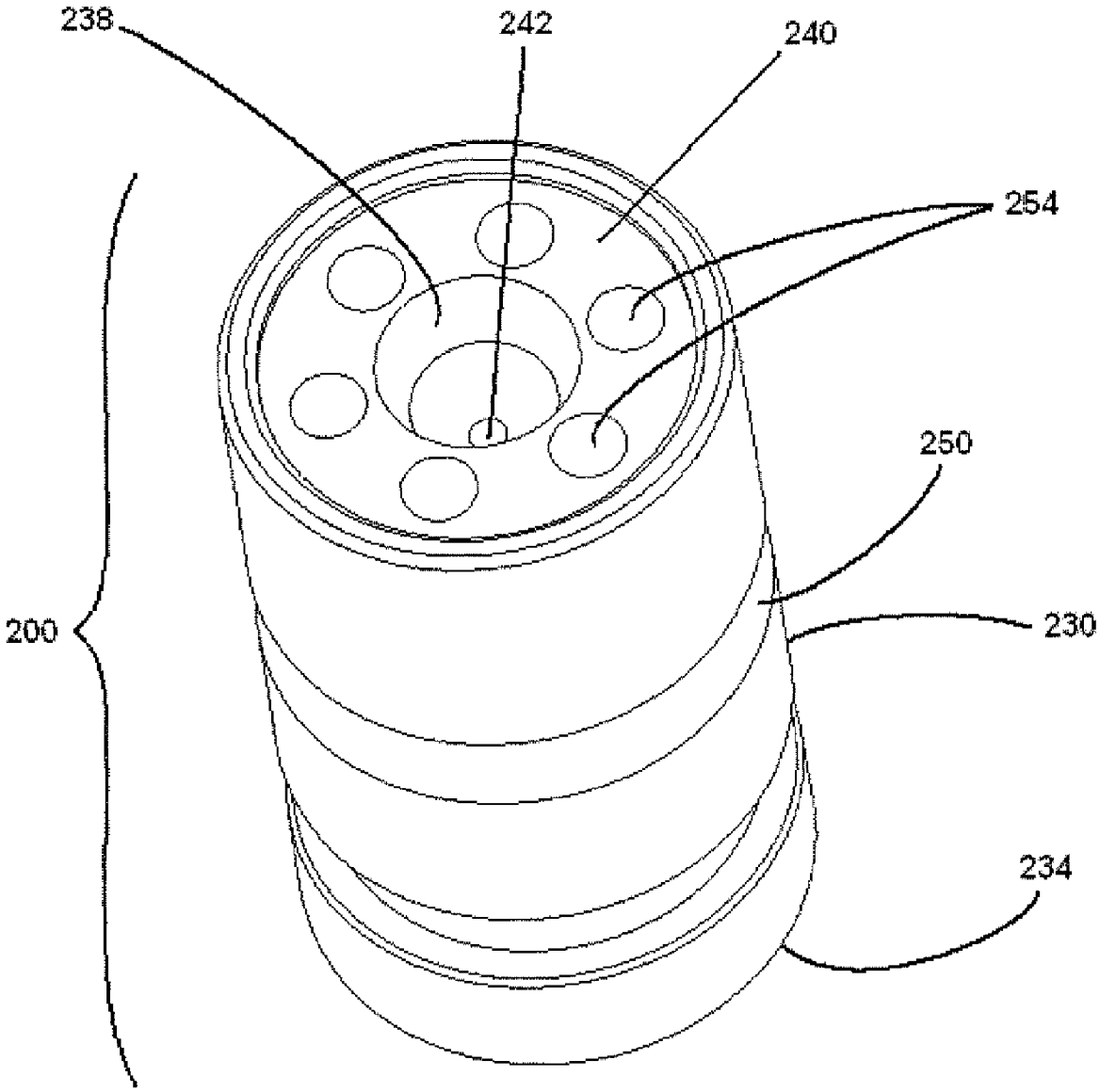
FIG. 18 is a perspective view of a valve lifter according to one aspect of the present invention.

As shown in FIG. 18, lifter 200 has a generally cylindrical body, 230, with a lower end, 234, which is adapted for contact with one of lobes 190 of camshaft 186. Body 230 of lifter 200 also has an upper end, 240, having a hemispherical depression, 238, shown with specificity in FIG. 18. Hemispherical depression 238 engages one of valve operating push rods 204 as shown in FIG. 16.

Each of valve lifters 200 has a center bore, 242, which feed oil up through hollow push rods 204 to the upper part of cylinder assembly 16. The oil is furnished to center bore 242 by means of a radially directed passage, 246, formed in lifter body 230. Radially directed passage 246 allows communication with an annular lubrication collection passage, 250, which circumscribes a portion of the outer cylindrical surface of lifter body 230. In essence, passage 228 formed in lifter sleeve 194 is located so as to be in hydraulic communication with annular lubrication collection passage 250 formed in lifter body 230. As a result pressurized oil is fed through center bore 242 to push rods 204, as described above.

Figure 19:
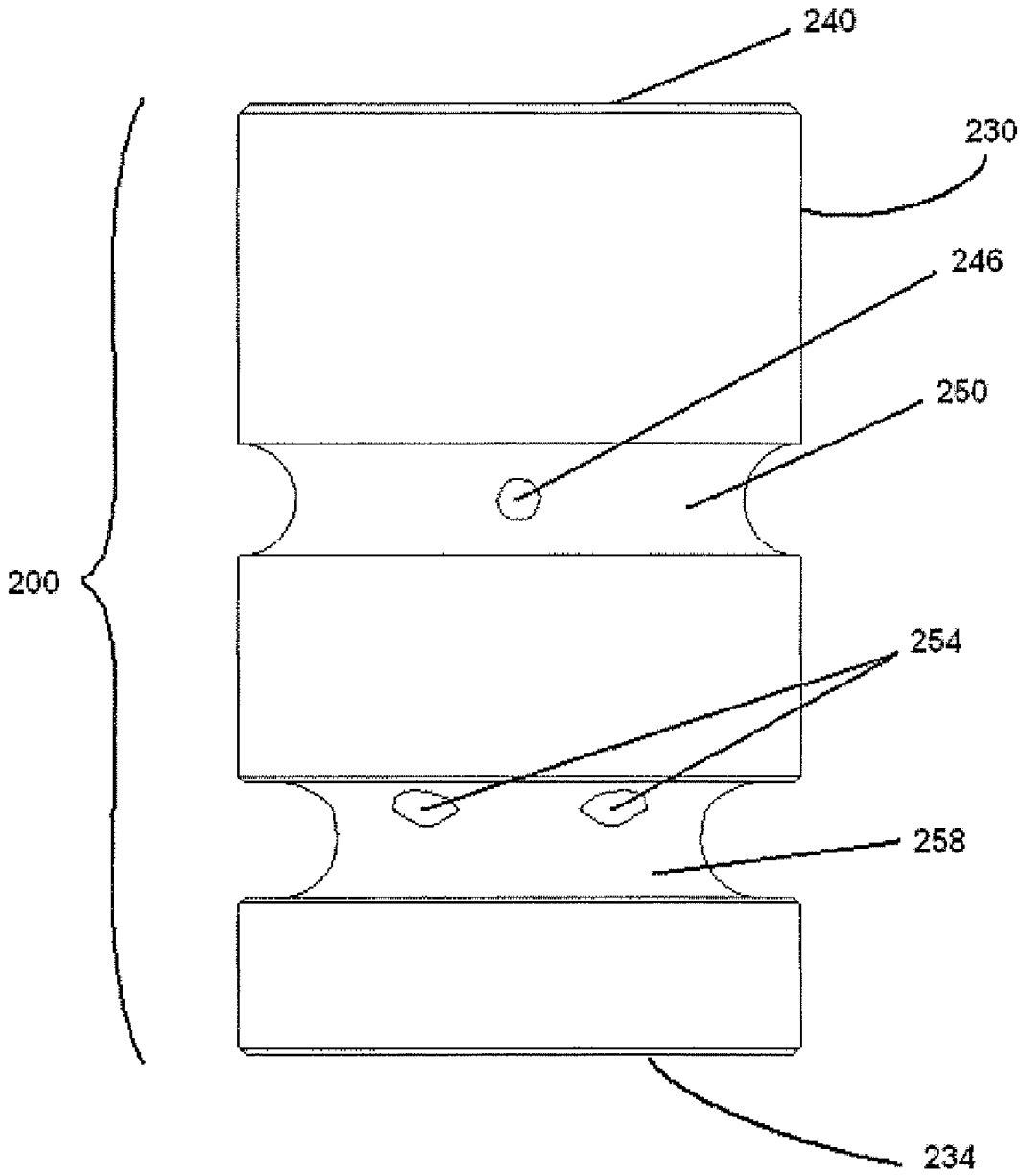
FIG. 19 is a plan view of a valve lifter of FIG. 18.
Figure 20:
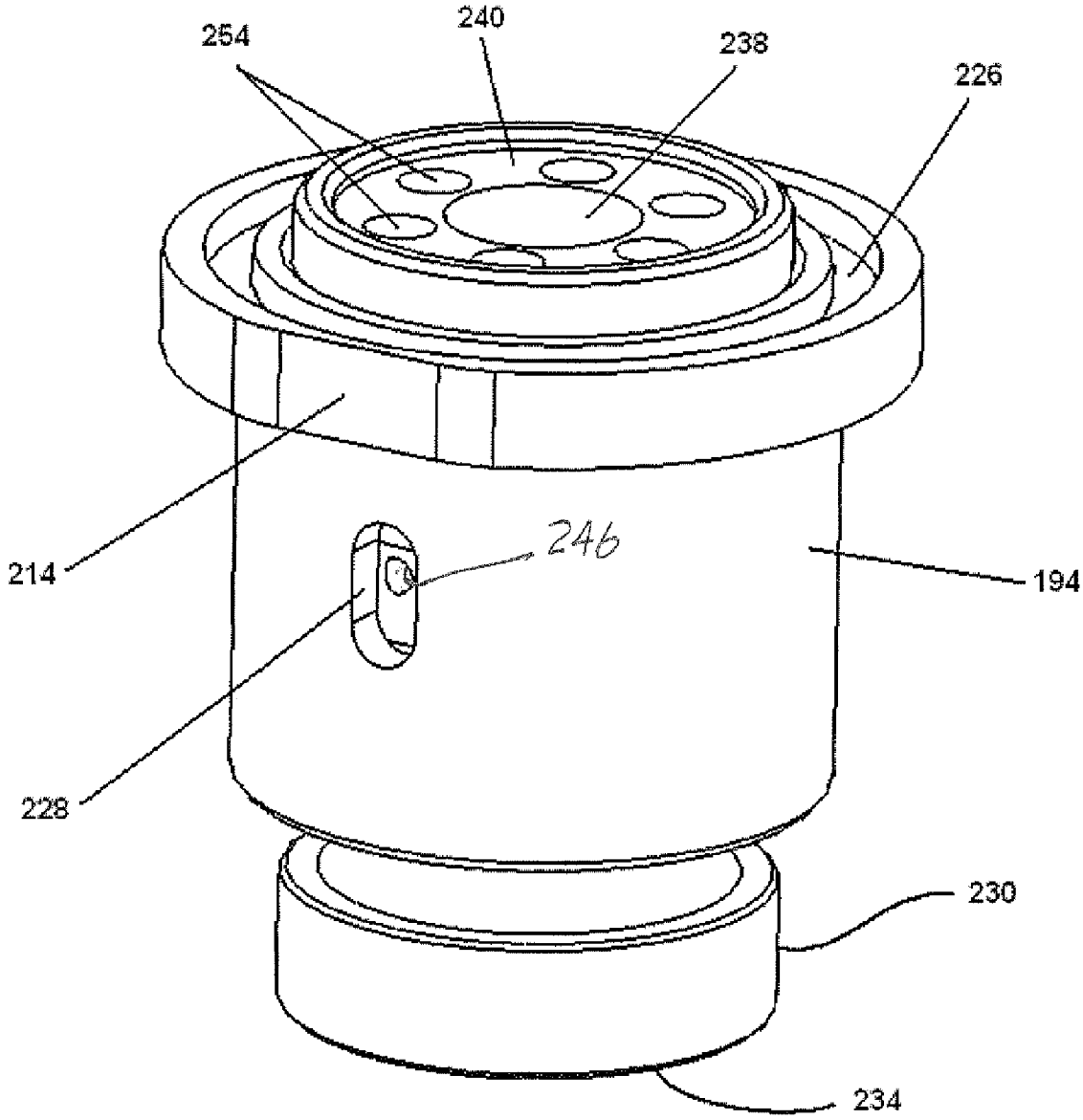
FIG. 20 is a perspective view of a valve lifter slidingly carried within a valve lifter sleeve according to the present invention.

Once engine oil has been used in the upper portion of cylinder assembly 16 to lubricate valve guides and the rocker shafts and associated equipment, oil drains back through passages 208 and then drains down through lifter body 230 through a number of drainback passages, 254, located radially outward from center bore 242. Drainback passages 254 extend axially through the greater part of valve lifter body 230 so that lubricating oil will be allowed to flow down through body 230 and then to exit into drainback annulus 258 (FIG. 19), from which the oil drains down over the lowermost portion of the outer surface of lifter body 230, and then onto camshaft 186 (FIG. 16).

Figure 21:
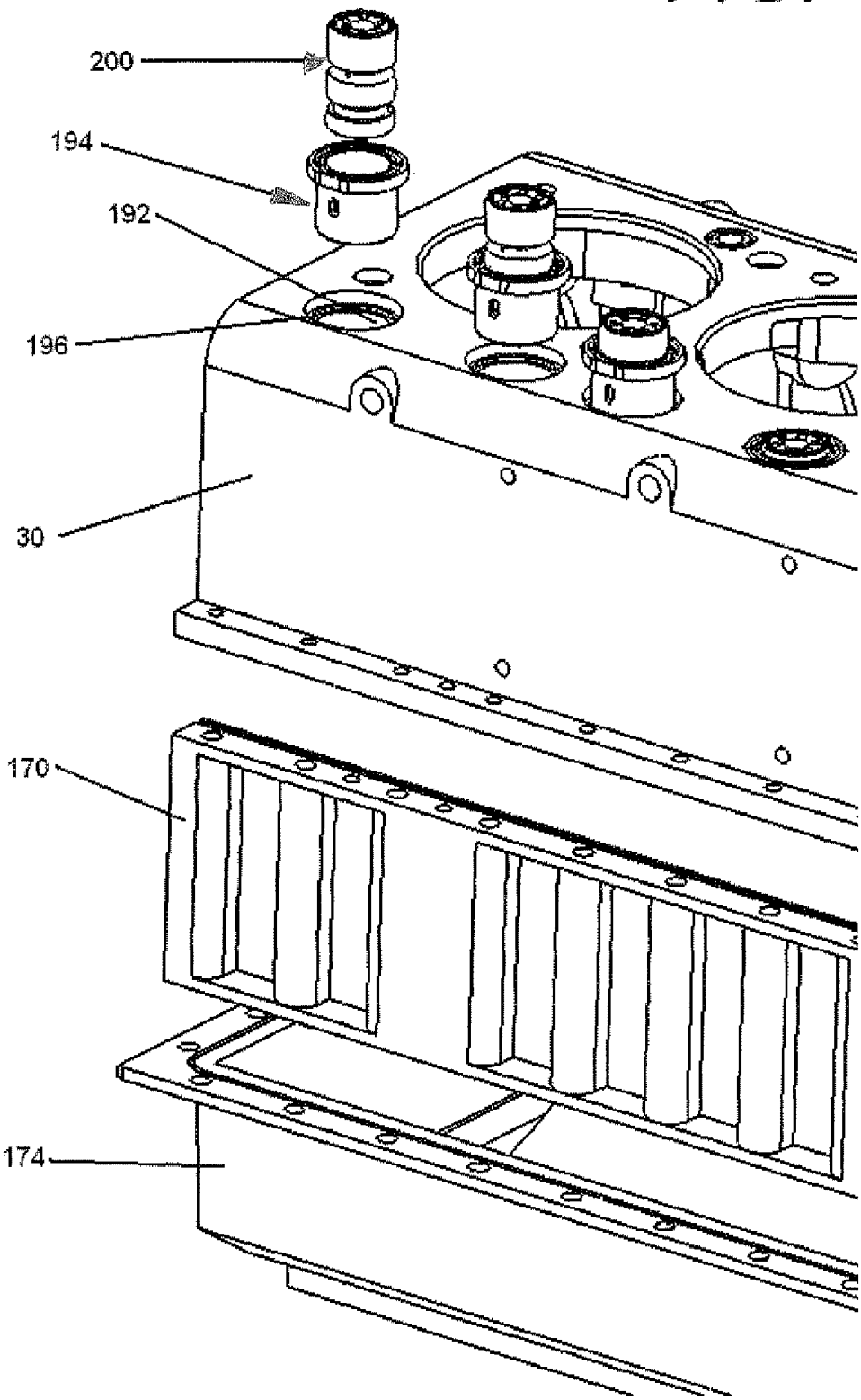
FIG. 21 is an exploded perspective view of an engine showing various features according to the present invention.

FIG. 21 is an exploded perspective view showing unitary carrier 30, with a structural rail, 170, and oil pan 174, according to the present invention. FIG. 21 also shows assembly of valve lifter sleeves 194 and valve lifters 200 into lifter bores 192, complete with counter bores 196 within cylinder carrier 30. FIG. 21 shows that valve lifters 200 are telescopically nested into valve lifter sleeves 194. As noted above, the use of valve lifter sleeves 194 permits an engine constructed according to the present invention to be rebuilt in the field without the use of expensive machining services and indeed, without the necessity of removing an engine from a vehicle or watercraft or other piece of equipment. Contrary to usual practice, it is not necessary to re-bore a cylinder block in the event that the valve lifter has failed and damaged the bore in which it is housed. Rather, sleeves 194 may be removed and replaced with new sleeves and new lifters 200, allowing the engine to be placed back in service without machine shop work to the cylinder block.

While particular embodiments of the invention have been shown and described, numerous variations and alternate embodiments will occur to those skilled in the art. Accordingly, it is intended that the invention be limited only in terms of the appended claims.

What is claimed is:

1. An internal combustion engine, comprising: a cylinder carrier having a deck surface;

a crankshaft mounted within said cylinder carrier;

a camshaft mounted within said cylinder carrier;

a valve lifter sleeve mounted within a bore formed in said deck surface; and at least one cylinder assembly mounted to said deck surface of said cylinder carrier, with said cylinder assembly abutting an upper portion of said valve lifter sleeve, whereby said valve lifter sleeve will be retained within said bore.

2. An internal combustion engine according to claim 1, wherein said valve lifter sleeve comprises a generally circular, hollow cylinder having a flange at one end which engages a counterbore formed in said deck surface.

3. An internal combustion engine according to claim 1, further comprising a valve lifter slidingly housed within said valve lifter sleeve, with said valve lifter having a generally cylindrical body with a lower end in contact with a lobe on said camshaft, and an upper end in contact with a valve operating pushrod.

4. An internal combustion engine according to claim 3, wherein said valve lifter further comprises:

a center bore for feeding lubricating oil into the pushrod;

an annular lubrication collection passage formed in the outer cylindrical surface of the valve lifter body; and at least one radially directed passage for conducting lubricant from said annular lubrication collection passage to said center bore.

5. An internal combustion engine according to claim 4, wherein said valve lifter further comprises at least one drainback passage located radially outward from said center bore, and extending axially through at least a portion of said valve lifter, whereby lubricating oil will be allowed to flow from an upper portion of the engine and through said valve lifter drainback passage to said camshaft lobe, whereby said camshaft lobe will be lubricated.

6. An internal combustion engine according to claim 2, wherein said valve lifter sleeve further comprises an elongated, radially directed passage for receiving lubricating oil from a passage within said carrier, with said radially directed passage being in hydraulic communication with an annular lubrication collection passage formed in an outer cylindrical surface of a valve lifter slidingly housed within said valve lifter sleeve.

7. An internal combustion engine according to claim 1, wherein said cylinder carrier comprises a modular cylinder carrier.

8. An internal combustion engine according to claim 1, wherein said cylinder carrier comprises a unitary cylinder carrier.

9. An internal combustion engine according to claim 1, further comprising at least one structural rail extending parallel to a centerline of said crankshaft, with said structural rail being attached to the lower periphery of said cylinder carrier.

10. An internal combustion engine, comprising:

a cylinder carrier having a deck surface with a plurality of counterbored valve lifter bores;

a crankshaft mounted within said cylinder carrier;

a camshaft mounted within said cylinder carrier;

a plurality of flanged valve lifter sleeves mounted in a depending orientation within said valve lifter bores;

a plurality of cylinder assemblies mounted to said deck surface, with each of said cylinder assemblies abutting a flanged upper portion of a plurality of said valve lifter sleeves, whereby said valve lifter sleeves will be retained within said bores;

a plurality of valve lifters housed within said valve lifter sleeves, with each of said valve lifters having a center bore for feeding lubricating oil into a pushrod extending into an upper portion of the engine, and with each of said valve lifters having a plurality of drainback passages, located radially outward from said center bore, for allowing lubricating oil to drain from an upper portion of the engine to said camshaft, whereby said camshaft will be lubricated.

11. An internal combustion engine according to claim 10, further comprising a plurality of structural rails extending parallel to a centerline of said crankshaft, with said structural rails being attached to the lower periphery of said cylinder carrier and extending between the cylinder carrier and an oil pan.

12. A method for installing a cylinder poppet valve operating system in an internal combustion engine, comprising:

installing a camshaft in a cylinder carrier having a deck surface;

installing a valve lifter sleeve in a bore formed through said deck surface;

installing a valve lifter in said lifter sleeve; and installing a cylinder assembly upon said deck surface, such that said cylinder assembly contacts a portion of said valve lifter sleeve, whereby said valve lifter sleeve will be retained within said bore.

13. A method according to claim 12, further comprising:

installing a pushrod through a passage within said cylinder assembly, such that the pushrod is in contact with an upper surface of said valve lifter; and installing a rocker arm assembly upon a cylinder head mounted at an upper portion of said cylinder assembly.

* * * * *